United States Patent [19]

Ikebe et al.

[11] Patent Number: 4,774,433

[45] Date of Patent: Sep. 27, 1988

[54] APPARATUS FOR GENERATING METAL IONS

[75] Inventors: Yoshinori Ikebe, Katsuta; Hifumi Tamura, Hachioji; Hiroyasu Shichi, Kokubunji; Eiichi Izumi, Takahagi, all of Japan

[73] Assignee: Hitachi, Ltd., Tokyo, Japan

[21] Appl. No.: 36,488

[22] Filed: Apr. 9, 1987

[30] Foreign Application Priority Data

Apr. 9, 1986 [JP] Japan ..... 61-79938

[51] Int. Cl.[4] ..... H01J 27/00; H01J 27/26

[52] U.S. Cl. ..... 313/362.1; 313/363.1; 313/550; 315/111.81; 250/423 R

[58] Field of Search ..... 313/550, 360.1, 362.1, 313/363.1, 15; 250/423 R, 423 F, 424, 425; 315/111.81

[56] References Cited

U.S. PATENT DOCUMENTS

| | | | |
|---|---|---|---|
| 2,715,694 | 8/1955 | Yockey | 313/550 X |
| 4,638,217 | 1/1987 | Okubo et al. | 250/423 R |
| 4,687,938 | 8/1987 | Tamura et al. | 250/423 R |

FOREIGN PATENT DOCUMENTS

| | | | |
|---|---|---|---|
| 0030055 | 2/1983 | Japan | 250/423 R |
| 0121536 | 7/1983 | Japan | 250/423 R |
| 0180048 | 9/1985 | Japan | 250/423 R |

*Primary Examiner*—David K. Moore
*Assistant Examiner*—Michael Horabik
*Attorney, Agent, or Firm*—Antonelli, Terry & Wands

[57] ABSTRACT

A mixture of an alkali metal compound and its reducing agent is heated by a heating means, whereby alkali metal vapors are generated and stored in a vapor reserver. The thus stored vapors permeate through a porous member heated by another heating means and are ionized. The thus formed ions are withdrawn by an ion withdrawal means.

2 Claims, 1 Drawing Sheet

APPARATUS FOR GENERATING METAL IONS

BACKGROUND OF THE INVENTION (1) Field of the Invention

This invention relates to an apparatus for generating metal ions, and particularly to an apparatus for generating metal ions suitable for use in an ion microanalyzer, etc.

(2) Prior Art

So far known apparatus for generating metal ions for use in an ion microanalyzer, etc., particularly apparatus for generating cesium ions, includes a type of placing metallic cesium in a reservoir, evaporating the metallic cesium by heating, and leading the resulting cesium vapor to an ionization zone, a type of supplying metallic cesium as a liquid to a capillary emitter and evaporating and ionizing the liquid cesium by applying a high electrical field to the tip end, etc. All of these types use the metallic cesium, which must be carefully handled, because the metallic cesium vigorously reacts with air upon contact with the air, and thus is quite hazardous.

Thus, attempts have been made to use a metal cesium compound in place of metallic cesium. Processes for producing cesium ions from a metal cesium compound include a process for reacting a cesium compound with a reducing agent by electron bombardment heating, thereby generating and ionizing the metallic cesium vapor, as disclosed in Japanese Patent Application Kokai (Laid-open) No. 58-42149 and a process for reacting a cesium compound with a reducing agent at a high temperature, thereby generating metallic cesium vapor, condensing the vapor into a liquid metallic cesium, and supplying the liquid metallic cesium to the tip end of needle-like electrode, thereby ionizing it, as disclosed in Japanese Patent Application Kokai (Laid-open) No. 58-158839. In the former process, generation of metallic cesium vapor and ionization of the vapor are carried out by one electron bombardment heating means. However, the generation temperature of metallic cesium vapor and its ionization temperature are different from each other, and the latter temperature is higher than the former temperature. When the electron bombardment heating temperature is set to a suitable one for generating the metallic cesium vapor, the vapor is not thoroughly ionized, and flows toward an ion withdrawal electrode and fouls the electrode, etc. On the other hand, when the temperature is set to a suitable one for ionizing the metallic cesium vapor, the vapor is excessively generated, and a portion of the vapor is not ionized also in this case, and flows towards the ion withdrawal electrode and fouls the electrode, etc.

In the latter process, a means for liquefying the cesium vapor must have a structure of large thermal radiation, and a means for forced cooling must be provided, but it is difficult from a practical standpoint to satisfy these conditions in on small apparatus for generating ions.

SUMMARY OF THE THE INVENTION

An object of the present invention is to provide an apparatus for generating metal ions without liquefying the metal vapor, free from any fouling problem.

According to the present invention, there is provided an apparatus for generating metal ions, which comprises a vessel for encasing a mixture of an alkali metal compound and a reducing agent, a means for heating the mixture in the vessel, thereby reacting the alkali metal compound with the reducing agent in the vessel and generating the alkali metal vapors, a vapor reservoir for storing the generated alkali metal vapors, a porous member capable of permeating the alkali metal vapors therethrough and having a higher melting point than the ionization temperature of the alkali metal vapors, the porous member being formed as a part of wall of the vapor reservoir, a means for heating the porous member, thereby ionizing the alkali metal vapors permeated through the porous member and generating the ions, and a means for withdrawing the generated ions.

In the vessel for encasing the mixture, the mixture is heated by the heating means, whereby the alkali metal compound is allowed to react with the reducing agent to generate the alkali metal vapor, which is stored in the vapor reservoir.

The alkali metal vapor stored in the vapor reservoir permeates through a porous member having a higher melting point than the ionization temperature of the alkali metal vapor, the porous member being formed as a part of wall of the vapor reservoir. The alkali metal vapor thus permeated through the porous member is ionized by heating the porous member through the heating means, and the resulting alkali metal ions are withdrawn by an ion withdrawal means.

The site for generating the alkali metal vapor and the site for ionizing the vapor are independent from each other, and the means for heating the mixture, thereby generating the alkali metal vapor and the means for heating the porous member, thereby ionizing the alkali metal vapor are independent from each other. That is, the temperature for generating alkali metal vapor and the temperature for ionizing the vapor can be set to optimum temperatures independently, and thus the generated alkali metal vapors are enclosed in the vapor reservoir, and never leak toward the ion withdrawal means. Furthermore, the present apparatus for generating metal ions requires no liquefaction of alkali metal vapor and is free from any fouling problem.

EMBODIMENTS

Figure 1:
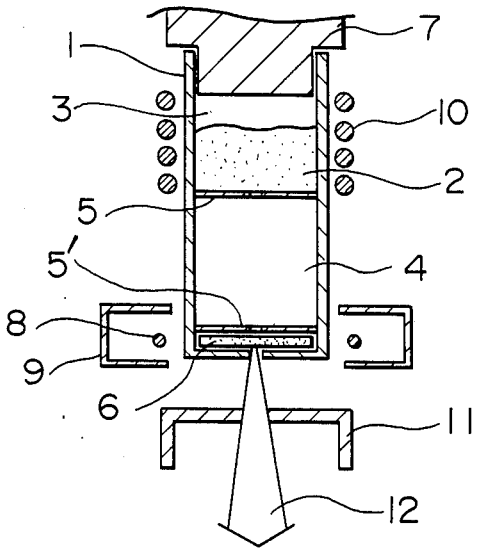
FIG. 1 is a cross-sectional sectional view of an embodiment according to the present invention.

FIG. 1 shows an embodiment according to the present invention. A vessel 1 made of tantalum for ionizing a raw material having a raw material filling compartment for filling a mixture 2 of a cesium compound as a kind of alkali metal compound and its reducing agent, i.e. vessel 3, a cesium reservoir 4 for storing metallic cesium vapors generated by chemical reaction of the mixture 2, the cesium reservoir being partitioned by orifice plates 5 and 5' each having a center hole, about 100 μm in diameter, made of tantalum, at two stages, and a porous member 6 provided at the tip end of the vessel 1 as an ion emitter is provided on a vessel support 7 made of stainless steel. The raw material filling compartment 3 is hermetically sealed by the vessel support 7. Furthermore, the vessel 1 is provided with a tungsten filament 8 for electron bombardment heating of the porous member 6, a Wehnelt cylinder 9 for auxiliary control, a heater 10 for resistance heating of the mixture 2 of the cesium compound and its reducing agent, and a withdrawal electrode 11 for withdrawing ions generated by surface ionization through the porous member 6.

The porous member 6 is made of tungsten capable of permeating cesium metal vapor therethrough and having a higher melting point than the ionization temperature of cesium metal vapors.

The working principle of the present embodiment will be described below.

The vessel 1 for ionizing a raw material, provided with the raw material filling compartment, i.e. vessel 3, filled with the mixture 2 of cesium chromate ($Cs_2CrO_4$) as a cesium compound and silicon (Si) as its reducing agent, is fixed to the vessel support 7. Then, the ion source is vented to vacuum, and the mixture 2 is heated to 500° C. or higher, for example, 600° to 800° C., by the heater 10, whereby metallic cesium vapors can be obtained according to the following chemical equation:

$$4Cs_2CrO_4+5Si \rightarrow 8Cs+2Cr_2O_3+5SiO_2$$

The thus obtained metallic cesium vapors pass through the orifice plate 5 and diffuse into the cesium reservoir 4 owing to the vapor pressure prevailing in the raw material filling chamber 3. Furthermore, the cesium vapors pass through the orifice plate 5' owing to the vapor pressure prevailing in the cesium reservoir 4 and flow toward the porous member 6. On the other hand, the porous member 6 is heated to 1,100° C. or higher by electron bombardment from the filament 8, where a condition of $\phi > I$ is established between the ionization potential of cesium ($I=3.89$ eV) and the work function of tungsten ($\phi=4.5$ eV). The cesium vapors are ionized by surface ionization through the porous member 6, and withdrawn as an ion beam 12 by the withdrawal electrode 11.

In the present embodiment, the following effects can be obtained.

(1) The mixture of cesium chromate and silicon is easy to handle.

(2) $Cr_2O_3$ and $SiO_2$ formed by the chemical reaction between cesium chromate and silicon remain in the raw material filling compartment 3 and only the cesium vapors are stored in the cesium reservoir 4. The temperature for generating the cesium vapors and the temperature for its ionization are independently set to optimum ones, and thus the generated cesium vapors are not scattered from the cesium reservoir 4 and are prevented from fouling of the ion source including the withdrawal electrode 11.

Figure 2:
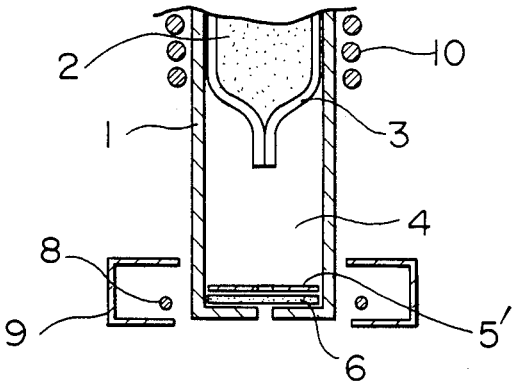
FIG. 2 is a cross-sectional view of another embodiment according to the present invention.

Another embodiment of the present invention will be described, referring to FIG. 2.

The structure of the apparatus is the same as in FIG. 1, except for the raw material filling compartment, i.e. vessel 3. The raw material filling compartment has a fine hole, about 10 μm in diameter, at the tip end and is made of quartz glass.

The vessel 1 for ionizing a raw material, provided with the raw material filling compartment 3 filled with a mixture 2 of cesium chromate and silicon, is fixed to the vessel support 7. Then, the ion source is vented to vacuum, and the mixture 2 is heated to 500° C. or higher by the heater 10, whereby cesium vapors can be obtained. The cesium vapors diffuse into the cesium reservoir 4 through the fine hole. The successive working principle is the same as in the embodiment of FIG. 1. When the raw material filling compartment 3 is not heated by the heater 10, the fine hole serves to act as a lid, and the cesium vapors never diffuse into the cesium reservoir 4. On the other hand, when the compartment 3 is heated by the heater 10, the fine hole enlarges by thermal expansion to allow the cesium vapors to pass therethrough. That is, by turning the heater 10 on or off, or by appropriately adjusting the temperature of the heater 10, the amount of cesium vapors to be generated, that is, the amount of cesium vapors to be supplied to the cesium reservoir 4, can be controlled.

The mixture is not limited to the said example, but the following mixtures can be used:

$CsMo+Ti$, $CsCr_4O_3+Si$, and $Cs_3CO_3+Mg$

Beside cesium, the following alkali metal compounds and their reducing agents can be used:

$K_2CO_3+C$, $LiCl+Ca$, $LiCl+Mg$, $Rb_2CrO_2+Zr$, etc.

What is claimed is:

1. An apparatus for generating metal ions comprising: a vessel for holding a mixture of an alkali metal compound and a reducing agent, means for heating the mixture in the vessel to thereby react the alkali metal compound with the reducing agent in the vessel and generate alkali metal vapors, a vapor reservoir in fluid communication with said vessel for storing the generated alkali metal vapors, a porous member formed as part of a wall of the vapor reservoir capable of being permeated by the alkali metal vapors and having a higher melting point than the ionization temperature of the alkali metal vapors, means for heating the porous member to ionize alkali metal vapors which have permeated through the porous member and thereby generate the metal ions, and means for withdrawing the generated ions.

2. An apparatus according to claim 1, wherein the vessel is in communication with the vapor reservoir through a fine hole whose opening is changeable with temperature and which serves to act as a lid preventing vapors to diffuse into the reservoir when the vessel is not heated.

* * * * *